US008585051B2

(12) United States Patent
Arakane

(10) Patent No.: US 8,585,051 B2
(45) Date of Patent: Nov. 19, 2013

(54) IMAGE RECORDING DEVICE, IMAGE RECORDING METHOD AND COMPUTER-READABLE MEDIUM WITH

(75) Inventor: Satoru Arakane, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/433,626

(22) Filed: Mar. 29, 2012

(65) Prior Publication Data

US 2013/0049281 A1 Feb. 28, 2013

(30) Foreign Application Priority Data

Mar. 31, 2011 (JP) ..... 2011-080206

(51) Int. Cl.
*B65H 7/02* (2006.01)

(52) U.S. Cl.
CPC ..... *B65H 7/02* (2013.01)
USPC ..... 271/258.01; 271/176; 399/81

(58) Field of Classification Search
USPC ..... 271/3.15, 258.01, 176; 399/81, 83
See application file for complete search history.

(56) References Cited

U.S. PATENT DOCUMENTS 5,585,943 A * 12/1996 Kikuchi ..... 271/9.09
7,938,393 B2 * 5/2011 Yako ..... 271/258.01
8,047,539 B2 * 11/2011 Fujita ..... 271/258.01
8,186,674 B2 * 5/2012 Fujita ..... 271/258.01
8,313,098 B2 * 11/2012 Hattori et al. ..... 271/176

FOREIGN PATENT DOCUMENTS

| | | | |
|---|---|---|---|
| JP | 04091553 A | * | 3/1992 |
| JP | H04-091553 A | | 3/1992 |
| JP | H04-164768 A | | 6/1992 |
| JP | 05024318 A | * | 2/1993 |
| JP | H05-024318 A | | 2/1993 |
| JP | H06-001491 A | | 1/1994 |
| JP | H06-236085 A | | 8/1994 |
| JP | H08-183212 A | | 7/1996 |
| JP | 09071363 A | * | 3/1997 |

* cited by examiner

*Primary Examiner* — Gerald McClain
(74) *Attorney, Agent, or Firm* — Baker Botts L.L.P.

(57) ABSTRACT

An image recording device including a recording unit that records an image on a paper sheet conveyed in a conveying direction along a conveyance path, a paper feed tray that feeds the paper sheet to the conveyance path, a stopper unit that holds the paper sheet to stop the conveyance of the paper sheet, a notifying unit that issues a notification requesting removal of the paper sheet held by the stopper unit, and a control unit that controls at least one of the notifying unit to issue the notification requesting the removal of the paper sheet and the stopper unit to release the paper sheet to allow the conveyance of the paper sheet, based on where an instruction for recording an image on another paper sheet is originated, when the paper sheet is held by the stopper unit.

16 Claims, 9 Drawing Sheets

IMAGE RECORDING DEVICE, IMAGE RECORDING METHOD AND COMPUTER-READABLE MEDIUM WITH

CROSS-REFERENCE TO RELATED APPLICATION

This application claims priority from Japanese Patent Application No. 2011-080206, filed on Mar. 31, 2011, which is incorporated herein by reference.

BACKGROUND OF THE INVENTION

1. Field of the Invention

The present invention relates generally to an image recording device which records an image on a sheet fed from a paper feed tray and outputs the sheet to a paper output tray.

2. Description of Related Art

A known image recording device records an image on a sheet fed from a paper feed tray and outputs the sheet to a paper output tray. The known image recording device may be a compact, space-saving image recording device. The maximum size of paper sheets that are received in the paper output tray of the known image recording device may be reduced. Further, the maximum size of the paper sheets may be greater than the paper output tray, such that, when the paper sheets are placed on the paper feed tray, only the front ends of the paper sheets in a feeding direction are supported by the paper output tray while the other portions of the paper sheets protrude from the paper feed tray.

SUMMARY OF THE INVENTION

When a paper sheet that is greater in size than the paper output tray is fed to the paper output tray, the paper sheet may fall from the paper output tray because the paper output tray does not support the entire paper sheet. Thus, the known image forming device may stop feeding the paper sheet while a rear end the paper sheet still is supported, in order to prevent the paper sheet from falling from the paper output tray. Nevertheless, with the rear end of the paper sheet supported, the known image recording device may not continue recording an image on the next paper sheet. Thus, before an image is recorded on the next paper sheet, it may be necessary to remove the paper sheet of which the rear end is supported.

The present invention may solve the aforementioned problem and an object thereof is to provide a more convenient image recording device in which whether forced output of a paper sheet having an image recorded thereon to a paper output tray is performed may be determined based on an issuer of a command.

According to an embodiment of the invention, an image recording device, comprising: a recording unit configured to record an image on a paper sheet conveyed in a conveying direction along a conveyance path; a paper output tray disposed downstream from the recording unit in the conveying direction and configured to receive the paper sheet; a paper feed tray configured to feed the paper sheet to the conveyance path; a stopper unit disposed between the recording unit and the paper output tray along the conveyance path and configured to hold the paper sheet to stop the conveyance of the paper sheet; a notifying unit configured to issue a notification requesting removal of the paper sheet held by the stopper unit; and a control unit configured to control at least one of the notifying unit to issue the notification requesting the removal of the paper sheet and the stopper unit to release the paper sheet to allow the conveyance of the paper sheet, based on where an instruction for recording an image on another paper sheet is originated, when the paper sheet is held by the stopper unit.

According to another embodiment of the invention, an image recording method comprising steps of: feeding a paper sheet from a paper feed tray to a conveyance path; recording an image on the paper sheet conveyed along the conveyance path; holding the paper sheet to stop the conveyance of the paper sheet; and selectively issuing a notification requesting removal of the paper sheet held by the holding step or releasing the paper sheet held by the holding step, or both, based on where an instruction for recording an image on another paper sheet is originated.

According to still another embodiment of the invention, a non-transitory computer-readable storage medium storing computer executable instructions to be executed by a processing device of an image recording device, such that the image recording device perform the steps of: feeding a paper sheet from a paper feed tray to a conveyance path; recording an image on the paper sheet conveyed along the conveyance path; holding the paper sheet to stop the conveyance of the paper sheet; and selectively issuing a notification requesting removal of the paper sheet held by the holding step or releasing the paper sheet held by the holding step, or both, based on where an instruction for recording an image on another paper sheet is originated.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Figure 1:
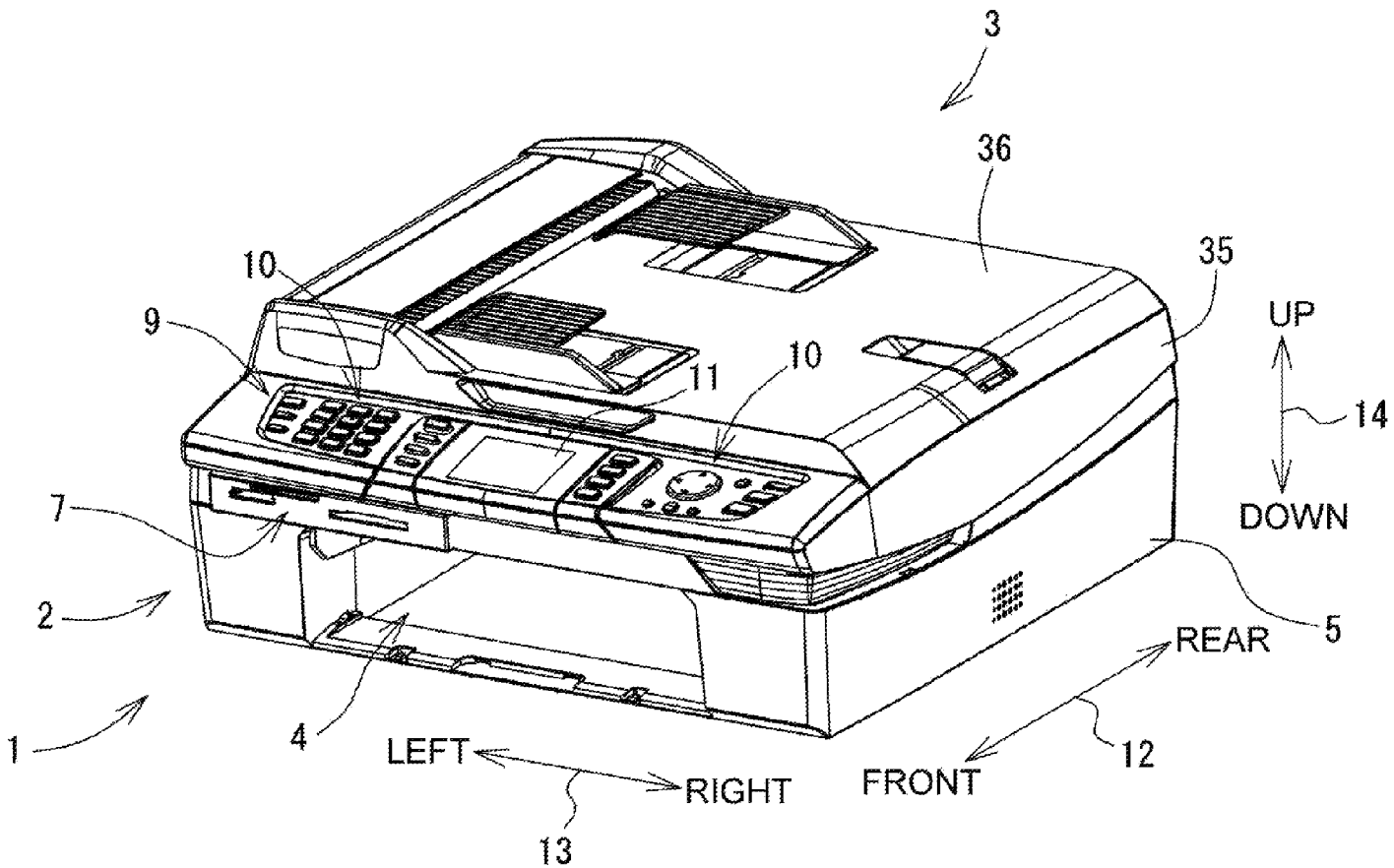
FIG. 1 is an exterior, perspective view of a multi-functional peripheral according to one or more aspects of the invention.

Embodiments of the invention now are described in detail with reference to the accompanying drawings, like reference numerals being used for like corresponding parts in the various drawings.

As depicted in FIG. 1, an up-down direction 14 may be defined with reference to an upright orientation in which a multi-functional peripheral 1 is intended to be used. A side of the multi-functional peripheral 1, where a manipulation panel 9 is provided, may be defined as the front of the multi-functional peripheral 1. A front-rear direction 12 may be defined with reference to the front of the multi-functional peripheral 1. A right-left direction 13 may be defined with respect to the multi-functional peripheral 1 as viewed from its front.

The multi-functional peripheral 1 may be a multi-functional device which may comprise a printing unit 2 and a scanner unit 3 disposed above the printing unit 2. The multi-functional peripheral 1 may perform, for example, a printer function, a scanner function, a copier function and a facsimile function. The printer function of the multi-functional peripheral 1 may perform single-side image recording or double-sided image recording.

The scanner unit 3 may comprise a document table 35 which may function as a flatbed scanner ("FBS"). A platen glass on which an original document is placed may be provided on a top surface of the document table 35. The scanner unit 3 may comprise an original document cover 36 disposed above the document table 35. The document cover 36 may selectively cover the document table 35. An image sensor may be disposed below the platen glass. The image sensor may read, e.g., scan, an image on the original document placed on the platen glass.

The multi-function device 1 may be connected to external information equipment, e.g., a personal computer, via, for example, a Local Area Network ("LAN"). A user may operate an input unit, e.g., a keyboard or a mouse, provided in the external information equipment. A command to record image data stored in a storage unit, e.g., a hard disk or the like, provided in the external information equipment, onto a recording sheet 19 may be sent to a microcomputer 130 together with the image data. The microcomputer 130 may control an operation of the multi-functional peripheral 1 based on the command sent from the external information equipment.

Figure 3:
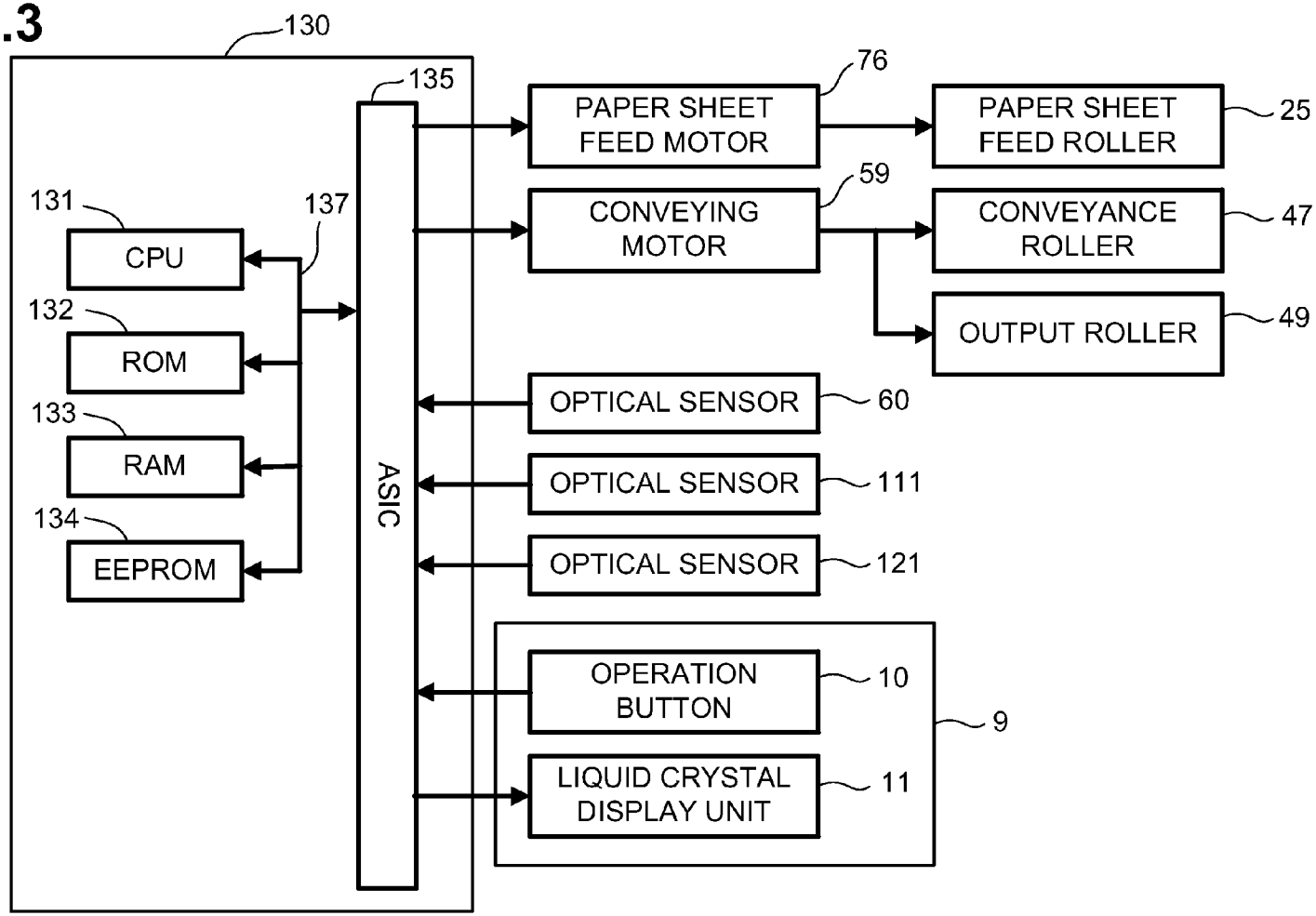
FIG. 3 is a block diagram depicting a configuration of a microcomputer according to one or more aspects of the invention.

An operation panel 9 may be disposed at the upper front side of a top surface of the multi-functional peripheral 1 and on a front-side top surface of the scanner unit 3. The user may operate the printing unit 2 and the scanner unit 3 by operating the operation panel 9. The operation panel 9 may include various operation buttons 10 and a liquid crystal display unit 11. The user may place an original document on the platen glass of the scanner unit 3 and may operate the operation panel 9. A command to read an image recorded on the original document as image data by an image sensor and to record the read image data on the recording sheet 19 may be sent to the microcomputer 130 from the operation panel 9. The manipulation panel 9 may instruct the multi-functional peripheral 1 to record an image on the recording sheet 19. As depicted in FIG. 3, the multi-functional peripheral 1 may be operated by the microcomputer 130 in response to a command sent from the operation panel 9 or from the external information equipment.

As depicted in FIG. 1, the printing unit 2 may comprise a casing 5 in which an opening 4 is formed in the front of the casing 5. The components of the printing unit 2 may be disposed inside the casing 5. The components may comprise, for example, a conveyance path 23, a recording unit 24, a paper feed tray 20, an output tray 21 and a manual feed tray 31.

Figure 2:
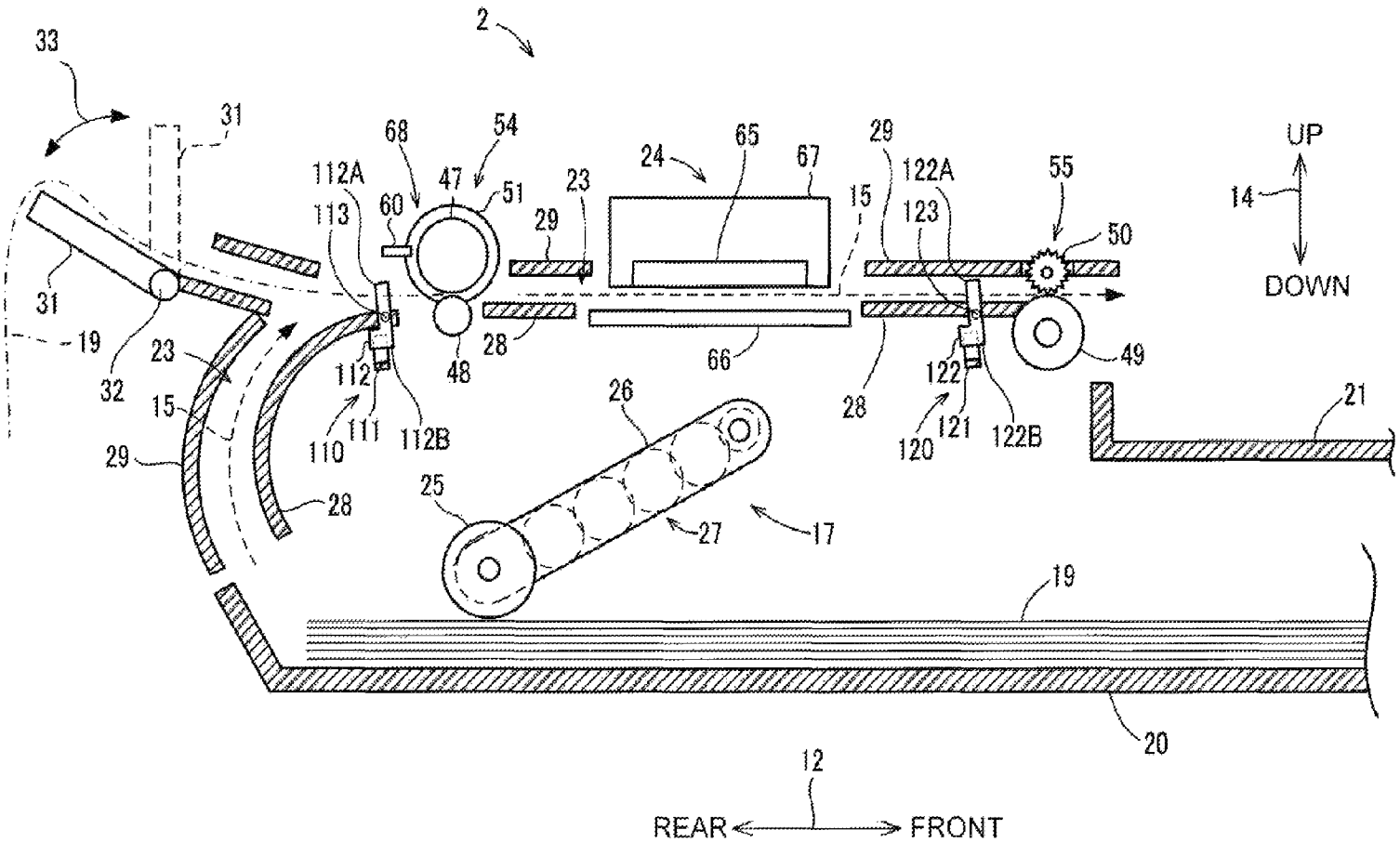
FIG. 2 is a longitudinal, cross-sectional view of an internal structure of a printing unit according to one or more aspects of the invention.

As depicted in FIG. 2, a paper feed tray 20 may selectively attach to and detach from the multi-functional peripheral 1 through the opening 4. When attached to the printing unit 2, the paper feed tray 20 may be disposed below the recording unit 24. The paper feed tray 20 may be formed in a substantially rectangular dish shape extending in a front-rear direction 12, e.g., a direction in which the paper feed tray 20 selectively attaches to and detaches from the multi-functional peripheral 1. The recording sheets 19 of desired size, e.g., DIN A4 and JIS B5, may be received in the paper feed tray 20. When the paper feed tray 20 is attached to the printing unit 2, the recording sheets 19 received in the paper feed tray 20 may be fed to the conveyance path 23 of the printing unit 2.

In the printing unit 2, the recording sheet 19 may be fed to the conveyance path 23 selectively from the paper feed tray 20 or from the manual feed tray 31. The recording sheet 19 may be output on a top surface of the paper output tray 21 after an image is recorded on the recording sheet 19 by the recording unit 24. The paper output tray 21 may receive the recording sheet 19 output from the printing unit 2. The paper output tray 21 may be disposed above the paper feed tray 20.

As depicted in FIG. 2, the manual feed tray 31 may be disposed on a rear side of the printing unit 2. The manual feed tray 31 may rotate in the direction of the arrow 33 about an axis 32 to cover and expose selectively a part of the rear side of the multi-functional peripheral 1. The manual feed tray 31 in the open position is depicted by a solid line. The manual feed tray 31 in the closed position is depicted by a dashed line. The manual feed tray 31 may receive the recording sheets 19 of various sizes. As depicted by a dash-dot line in FIG. 2, the recording sheet 19 may be placed on the manual feed tray 31, such that a front end thereof is in contact with a holding portion of a conveyance roller pair 54. The recording sheet 19 placed on the manual feed tray 31 may be fed to the conveyance path 23 of the printing unit 2. The recording sheet 19 may be received in the manual feed tray 31 such that a rear end of the recording sheet 19 trails from the manual feed tray 31. Thus, the manual feed tray 31 may receive a recording sheet 19 which is greater in size in the rear-front direction 12 than the paper output tray 21 and may feed the recording sheet 19 to the conveyance path 23. A recording sheet 19, which has a greater size than that of the paper output tray 21, may have a length in the front-rear direction 12 greater than the length of the paper output tray 21 in the front-rear direction 12.

The manual feed tray 31 may be configured to receive the recording sheet 19 which has greater size than the paper output tray 21. In another embodiment, the paper feed tray 20 may be configured to receive the recording sheet 19 which has greater size than the paper output tray 21. The printing unit 2 may comprise two trays, e.g., the paper feed tray 20 and the manual feed tray 31, configured to receive the recording sheet 19. In another embodiment, the printing unit 2 may comprise one tray, e.g., one of the paper feed tray 20 and the manual feed tray 31. In yet another embodiment, the printing unit 2 may further comprise a second paper feed tray below and overlapping the paper feed tray 20 in addition to the paper feed tray 20 and the manual feed tray 31.

The paper feeding unit 17 may be disposed above the paper feed tray 20. The paper feeding unit 17 may comprise a paper sheet feed roller 25, a paper feed arm 26, and a drive transmission mechanism 27. The paper sheet feed roller 25 may be rotatably supported at an end of the paper feed arm 26, which is configured to move up and down selectively, such that the paper sheet feed roller 25 may selectively approach and move away from the paper feed tray 20. The paper sheet feed roller 25 may be driven to rotate by a driving force transferred through the drive transmission mechanism 27 from a paper sheet feed motor 76. The drive transmission mechanism 27 may comprise a plurality of gears engaging one another. The paper sheet feed roller 25 may press on the recording sheet 19 placed in the paper feed tray 20 and may rotate to feed the recording sheet 19 from the stack of recording sheets 19 to the conveyance path 23.

The conveyance path 23 may extend from a rear end of the paper feed tray 20 upward and toward the front side of the multi-functional peripheral 1 in a curved manner, and then may extend from the rear side to the front side of the multi-functional peripheral 1. The conveyance path 23 may reach the paper output tray 21 via the conveyance roller pair 54, a position below the recording unit 24 and an output roller pair 55. The recording sheet 19 fed from the paper feed tray 20 may be guided along the conveyance path 23 upward to make a U-turn and reach the recording unit 24. The recording sheet 19 fed from the manual feed tray 31 may reach the recording unit 24 via the conveyance roller pair 54. The recording sheet 19 may be output to the paper output tray 21 after an image is recorded on the recording sheet 19 by the recording unit 24. The conveyance path 23 may be formed by an outer guide member 29 and an inner guide member 28 disposed opposite from the outer guide member 29 at a predetermined distance. The recording sheet 19 may be conveyed along the conveyance path 23 in a conveying direction 15, e.g., a direction depicted by an arrow of dashed line in FIG. 2.

As depicted in FIG. 2, a conveyance roller pair 54 may be disposed upstream from the recording unit 24 in the conveying direction 15. The conveyance roller pair 54 may comprise a conveyance roller 47 disposed above the conveyance path 23 and a pinch roller 48 disposed below the conveyance path 23. An output roller pair 55 may be disposed in the downstream from the recording unit 24 in the conveying direction 15. The output roller pair 55 may comprise an output roller 49 disposed below the conveyance path 23 and a spur 50 disposed above the conveyance path 23. The paper output tray 21 may be disposed downstream from the output roller pair 55 in the conveying direction 15. The paper output tray 21 may be disposed downstream from the recording unit 24 in the conveying direction 15. The output roller pair 55 may be disposed between the recording unit 24 and the paper output tray 21 along the conveyance path 23.

The conveyance roller 47 and the output roller 49 may be driven to rotate by a driving force transmitted from a conveying motor 59 via a drive transmission mechanism. When the conveyance roller 47 rotates in the forward direction, e.g., counterclockwise direction in FIG. 2, the recording sheet 19 fed from the paper feed tray 20 may be held by the conveyance roller pair 54 and be conveyed in the conveying direction 15. When the output roller 49 rotates in the forward direction, e.g., clockwise direction in FIG. 2, the paper sheet 19 on which an image is recorded by the recording unit 24 may be held by the output roller pair 55 and conveyed in the conveying direction 15. The recording sheet 19 may be output to the paper output tray 21 by the output roller pair 55.

A rotary encoder 68 may detect an amount of rotation of the conveyance roller 47. The rotary encoder 68 may comprise an encoder disc 51 and an optical sensor 60. The encoder disc may be coaxial with the conveyance roller 47 and may rotate with the conveyance roller 47. The encoder disc 51 may have a pattern in which transparent areas which transmit light and non-transparent areas which do not transmit light are arranged alternately in predetermined intervals in the circumferential direction of the encoder disc 51. When the encoder disc 51 rotates with the conveyance roller 47, a pulse signal may be generated by the optical sensor 60 detecting the pattern of the rotary encoder 68. The pulse signal generated by the optical sensor 60 may be output to the microcomputer 130.

The recording unit 24 may record an image on the recording sheet 19. The recording unit 24 may comprise a carriage 67. The carriage 67 may comprise a recording head 65 mounted thereon and may reciprocate in the main scanning direction, e.g., the left-right direction 13. Colored ink in cyan (C), magenta (M), yellow (Y) and black (Bk) may be supplied from an ink cartridge to the recording head 65. The recording head 65 may discharge ink droplets from nozzles provided on the lower side of the recording head 65. When the carriage 67 reciprocates in the main scanning direction, the recording head 65 may move to scan the recording sheet 19. An image may be recorded on the recording sheet 19 which is being conveyed on a platen 66 along the conveyance path 23 in the conveying direction 15. The platen 66 may be disposed below the recording unit 24 to face the recording unit 24. The platen 66 may support the recording sheet 19 being conveyed along the conveyance path 23. In another embodiment, the recording unit 24 may record an image on the recording sheet 19 by another method, e.g., a electrophotographic method.

The printing unit 2 may comprise a paper sheet detecting unit 110. The paper sheet detecting unit 110 may detect the recording sheet 19 conveyed along the conveyance path 23. The paper sheet detecting unit 110 may be disposed upstream from the conveyance roller pair 54 in the conveying direction 15 along the conveyance path 23. The paper sheet detecting unit 110 may comprise a rotary member 112 and an optical sensor 111, e.g., a photo interrupter. The rotary member 112 may comprise detection elements 112A and 112B. The optical sensor 111 may comprise a light emitting element, e.g., a light emitting diode, and a light receiving element, e.g., a phototransistor, which receives light emitted from the light emitting element. The rotary member 112 may rotate about a shaft 113. The detection element 112A may protrudes from the shaft 113 into the conveyance path 23. When no external force is applied to the rotary member 112, the detection element 112B may be disposed in an optical path extending from the light emitting element to the light receiving element of the optical sensor 111 and may block the light passing through the optical path. The rotary member 112 may rotate when pressed by a front end of the recording sheet 19, such that the detection element 112B may move out of the optical path to allow the light to pass along the optical path.

The printing unit 2 may comprise an output detecting unit 120 which detects the recording sheet 19 output from the conveyance path 23. The output detecting unit 120 may be disposed between the recording unit 24 and the output roller pair 55 along the conveyance path 23. In another embodiment, the output detecting unit 120 may be disposed between the output roller pair 55 and the paper output tray 21. The output detecting unit 120 may comprise a rotary member 122 and an optical sensor 121, e.g., a photo interrupter. The rotary member 122 may comprise detection elements 122A and 122B and a shaft 123. The optical sensor 121 may comprise a light emitting element, e.g., a light emitting diode, and a light receiving element, e.g., a phototransistor, which receives light emitted from the light emitting element. The configuration of the output detecting unit 120 may be substantially similar to that of the paper sheet detecting unit 110.

As depicted in FIG. 3, the microcomputer 130 may control the operations of the multi-functional peripheral 1. The microcomputer 130 may comprise a CPU 131, ROM 132, RAM 133, EEPROM 134, an ASIC 135 and an internal bus 137 which connects these components.

The ROM 132 may be a nonvolatile memory. Programs, by which the CPU 131 may control various operations of the multi-functional peripheral 1 including record control, may be stored in the ROM 132. The EEPROM 134 may be a nonvolatile memory. Setting and flags, which may be stored after powering-off, may be stored in the EEPROM 134. The RAM 133 may be a volatile memory. RAM 133 may be a storage area configured to record temporarily data used when CPU 131 performs various programs.

The ASIC 135 may connect the paper sheet feed motor 76, the conveying motor 59, an optical sensor 60 of the rotary encoder 68, the optical sensor 111 of the paper sheet detecting unit 110, the optical sensor 121 of the output detecting unit 120, and the operation panel 9. The ASIC 135 may comprise driving circuits for controlling each of the motors. When the CPU 131 inputs a drive signal for driving a predetermined motor to a driving circuit corresponding to the predetermined motor, a driving current in accordance with the drive signal may be output from the driving circuit to the corresponding motor. The corresponding motor may be rotated in the forward or reverse direction at a predetermined speed based on the drive signal.

The microcomputer 130 may control the conveying motor 59 to stop rotation of the output roller 49, such that the paper sheet 19 having an image recorded thereon is held by the output roller pair 55. The paper sheet 19 having an image recorded may stop moving and be held by the output roller pair 55. The recording sheet may not be output to the paper output tray 21 until the output roller 49 is again rotated by the microcomputer 130.

The optical sensors 111 and 121 may output an analog electrical signal, e.g., a voltage signal or a current signal, in accordance with intensity of light received by the light receiving element. The output signal may be input in the microcomputer 130. The microcomputer 130 may determine whether the level of the input signal, e.g., the voltage value or the current value, is above a predetermined threshold. If the input signal is above the predetermined threshold, the signal may be determined to be a HIGH level signal, and if the input signal is below the predetermined threshold, the signal is determined to be a LOW level signal. The microcomputer 130 may determine whether the recording sheet 19 has been detected by the paper sheet detecting unit 110 or by the output detecting unit 120, or by both.

If the electrical signal input from the optical sensor 111 is determined to be a HIGH level signal, the recording sheet 19 may be at a position along the conveyance path 23 at which the paper sheet detecting unit 110 is disposed. If the electrical signal input from the optical sensor 111 is determined to be a LOW level signal, the recording sheet 19 may not be at a position along the conveyance path 23 at which the paper sheet detecting unit 110 is disposed. The recording sheet 19 may be placed on the manual feed tray 31, such that the front end of the recording sheet 19 is in contact with the holding portion of the conveyance roller pair 54. If the recording sheet 19 is placed on the manual feed tray 31, the paper sheet detecting unit 110 may detect the recording sheet 19. If no recording sheet 19 is placed on the manual feed tray 31, the paper sheet detecting unit 110 may not detect the recording sheet 19. The paper sheet detecting unit 110 detect whether the recording sheet 19 is placed on the manual feed tray 31.

If the signal input from the optical sensor 121 is determined to be a HIGH level signal, the recording sheet 19 may be at a position at which the output detecting unit 120 is disposed along the conveyance path 23. If the signal input from the optical sensor 121 is determined to be a LOW level signal, the recording sheet 19 may not be at a position at which the output detecting unit 120 is disposed along the conveyance path 23. The microcomputer 130 may control the conveying motor 59 to stop rotation of the output roller 49 and thereby to stop conveyance of the paper sheet 19 having an image recorded thereon. If the conveyance of the paper sheet 19 having an image recorded thereon is stopped, the recording sheet 19 may be detected by the output detecting unit 120. If the conveyance of paper sheet 19 having an image recorded thereon is not stopped, the recording sheet 19 may be detected by the output detecting unit 120 while the paper sheet 19 is conveyed across the position at which the output detecting unit 120 is disposed. Nevertheless, the recording sheet 19 may not be detected by the output detecting unit 120 after the paper sheet 19 passes the position at which the output detecting unit 120 is disposed. The output detecting unit 120 may detect whether the output roller pair 55 stops the conveyance of the recording sheet 19.

The microcomputer 130 may count the number of pulses of the pulse signal from the optical sensor 60 starting from when the signal input from the optical sensor 111 is changed from a LOW level signal to a HIGH level signal, e.g., the time at which the front end of the recording sheet 19 passes the paper sheet detecting unit 110, until when the signal input from the optical sensor 111 is changed from a HIGH level signal to a LOW level signal, e.g., the time at which the rear end of the recording sheet 19 passes the paper sheet detecting unit 110. The microcomputer 130 may calculate, in accordance with the counting result, the length of the recording sheet 19 along the conveyance direction 15, e.g., the size of the recording sheet 19. A particular detecting unit may comprise the microcomputer 130, the paper sheet detecting unit 110, and the rotary encoder 68.

The microcomputer 130 may calculate the length of the recording sheet 19 in the conveying direction 15. In another embodiment, the microcomputer 130 may calculate the size of DIN A4 and JIS B5 based on a width of the recording sheet 19 in a direction perpendicular to the conveying direction 15, e.g., left-right direction 13. For example, the size name, e.g., DIN A4 and JIS B5, of the recording sheet 19, and the length in the conveying direction 15 and the width in the left-right direction 13 in accordance with the size name may be stored in the ROM 132 or in the EEPROM 134, as table data. The user may select the size name, e.g., DIN A4 and JIS B5, of the recording sheets 19 on the operation panel 9. The microcomputer 130 may acquire the length in the conveying direction 15 and the width in the left-right direction 13 corresponding to the size name of the selected recording sheet 19 by referring to the table data. The first detecting unit may comprise the microcomputer 130, the ROM 132 or the EEPROM 134, and the operation panel 9.

The microcomputer 130 may display a predetermined message on a liquid crystal display unit 11 of the operation panel 9 based on a predetermined condition. The predetermined message may notify a user to remove the recording sheet 19 stopped by the output roller pair 55. The microcomputer 130 may display a message on the liquid crystal display unit 11 to notify the user to remove the recording sheet 19 stopped by the output roller pair 55. A notifying unit may comprise the microcomputer 130 and the liquid crystal display unit 11. In another embodiment, the notification may be an audio message or buzzer output from a speaker.

Figure 4:
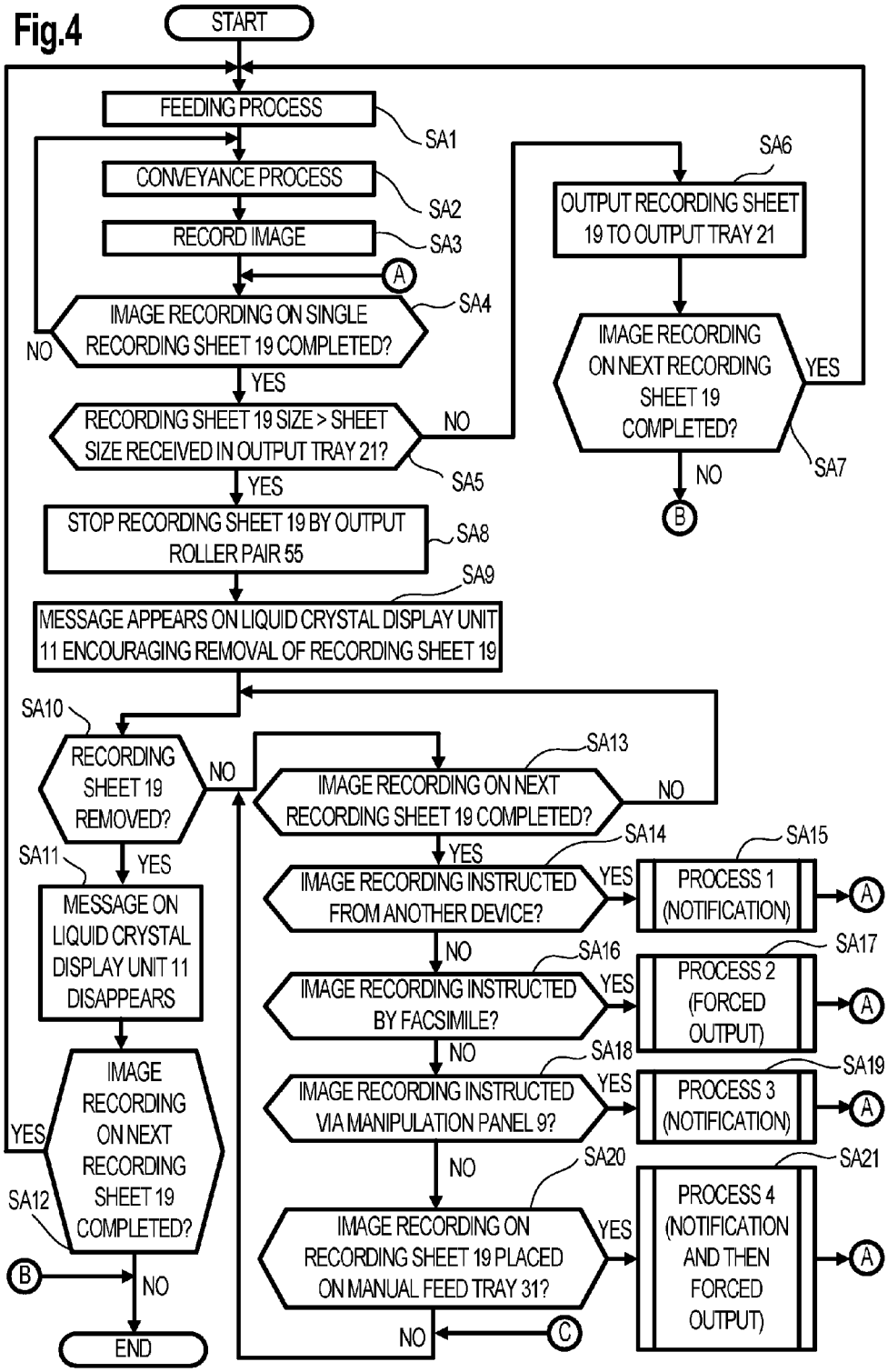
FIG. 4 is a flowchart depicting a process of record control according to one or more aspects of the invention.

As depicted in FIG. 4, when external information equipment or a operation panel 9 inputs a command in the multifunctional peripheral 1 to record image data on the recording sheet 19 received in the paper feed tray 20, the microcomputer 130 may drive the paper sheet feed motor 76 to rotate the paper sheet feed roller 25. In Step SA1, e.g., a feeding process, the recording sheet 19 received in the paper feed tray 20 may be conveyed along the conveyance path 23 toward the conveyance roller pair 54.

When the recording sheet 19 is conveyed by the rotation of the paper sheet feed roller 25 and reaches the conveyance roller pair 54, e.g., when the feeding process is completed, the microcomputer 130 may drive the conveying motor 59 to rotate the conveyance roller 47. The recording sheet 19, which has been conveyed along the conveyance path 23 by the paper sheet feed roller 25, may be held by the conveyance roller pair 54. The recording sheet 19 may be conveyed by the conveyance roller pair 54 to a position directly below the recording head 65 in Step SA2, e.g., a conveyance process.

When a command to record an image on the recording sheet 19 received in the manual feed tray 31 is input in the multi-functional peripheral 1 from the external information equipment or via the operation panel 9, the microcomputer 130 may drive the conveying motor 59 to rotate the conveyance roller 47. At Step SA2, the recording sheet 19 received in the manual feed tray 31 may be conveyed by the conveyance roller pair 54 to a position directly below the recording head 65. Thus, when a command is input to record an image on the recording sheet 19 received in the manual feed tray 31, the process of step SA1 may be skipped.

When the recording sheet 19 reaches the position directly below the recording head 65, the microcomputer 130 may control the recording head 65 to discharge ink droplets at Step SA3, e.g., an image recording process, while the carriage 67 moves in the left-right direction 13. The microcomputer 130 may control the conveyance of the recording sheet 19 at predetermined linefeed width and may control the discharge of the ink droplets until the entire image is recorded on the recording sheet 19 at Step SA4. Thus, an image may be recorded on a single recording sheet 19.

When the image is recorded on a single recording sheet 19, e.g., YES at Step SA4, the conveying motor 59 may be controlled such that the output roller 49 rotates to output the recording sheet 19. At Step SA5, the microcomputer 130 may compare the size of the paper sheet 19 having an image recorded thereon and the size of the recording sheet which may be received in the paper output tray 21. The microcomputer 130 may compare the size by comparing the length of the recording sheet 19 in the conveying direction 15, e.g., front-rear direction 12, with the length of the paper output tray 21 in the front-rear direction 12. The length of the paper sheet 19 in the conveying direction 15 may be calculated by counting the pulses of the pulse signal from the optical sensor 60. The size of the recording sheet which may be received in the paper output tray 21 may be a predetermined size of the paper output tray 21 in the front-rear direction 12. The predetermined size of the paper output tray 21 may be stored in the ROM 132 or in the EEPROM 134. The microcomputer 130 may compare the calculated length of the recording sheet 19 in the conveying direction 15 with the stored predetermined size of the paper output tray 21.

If the size of the paper sheet 19 having an image recorded thereon is determined to be greater than the size of the paper output tray 21 at Step SA5, e.g., if the length of the paper sheet 19 in the conveying direction 15 is greater than the length of the paper output tray 21 in the front-rear direction 12, the microcomputer 130 may control the conveying motor 59 to stop rotating the output roller 49, such that the conveyance of the recording sheet 19 may be stopped and the recording sheet 19 may be held by the output roller pair 55 at Step SA8.

At Step SA9, the microcomputer 130 may control the liquid crystal display unit 11 to display a message notifying the user to remove the recording sheet 19 held by the output roller pair 55. In another embodiment, an audio message or buzzer output from a speaker may be used to notify the user. If the command input in the microcomputer 130 in Step SA1 is from the external information equipment, the message in step SA9 may be displayed at the external information equipment or at the multi-functional peripheral 1, or both.

If the size of the paper sheet 19 having an image recorded thereon is determined to be less than or equal to the size of the paper output tray 21 at Step SA5, e.g., if the length in the conveying direction 15 of the paper sheet 19 is the same or less than the length of the paper output tray 21 in the front-rear direction 12, the microcomputer 130 may not stop the rotation of the output roller 49, such that the conveyance of the recording sheet 19 may continue and the recording sheet 19 may be output on the top surface of the paper output tray 21 at Step SA6. Then, if image recording is performed for the next recording sheet 19, e.g., YES at Step SA7, the process may be repeated from Step SA1. If no image recording is performed for the next recording sheet 19, e.g., NO at Step SA7, a series of record control may be completed.

When the recording sheet 19 held by the output roller pair 55 is removed by the user, e.g., YES at Step SA10, the microcomputer 130 may remove the message from the liquid crystal display unit 11 at Step SA11. The microcomputer 130 may determine that the recording sheet 19 has been removed if the electrical signal from the optical sensor 121 is a LOW level signal, and may determine that the recording sheet 19 has not been removed if the electrical signal from the optical sensor 121 is a HIGH level signal.

If an image is recorded on the next recording sheet 19, e.g., YES at Step SA12, the process may be repeated from Step SA1. If no image is recorded on the next recording sheet 19, e.g., NO at Step SA12, a series of record control may be completed.

If a command to record an image on the next recording sheet 19 is input while the recording sheet 19 held by the output roller pair 55 has not been removed, e.g., YES at Step SA13, the microcomputer 130 may perform one of process 1 at Step SA15, process 2 at Step SA17, process 3 at Step SA19, and process 4 at Step SA21, based on a command received for image recording.

If the command for image recording is received from another device, e.g., the external information equipment, other than the multi-functional peripheral 1 via a LAN, e.g., YES at Step SA14, the notification, e.g., the message displayed on the liquid crystal display unit 11, may be generated in process 1 at Step SA15. If the command is for receiving image data by facsimile from another device other than the multi-functional peripheral 1, e.g., YES at Step SA16, a forced output process, e.g., process 2, may be performed at Step SA17. If the command for image recording is issued by the operation of the operation panel 9 of the multi-functional peripheral 1, e.g., YES at SA18, the notification may be generated in process 3 at Step SA19. If the command is for recording an image on the recording sheet 19 received in the manual feed tray 31, e.g., YES at Step SA20, the notification may be generated and the forced output process may be performed in process 4 at Step SA21. If the command is not for any one of Steps SA14, SA16, SA18 and SA20, the process may return to Step SA13.

The microcomputer 130 may perform one of Steps SA14, SA18, SA18, and SA20, based on whether the command for recording an image on a next recording sheet 19 at Step SA13 is received from the operation panel 9 or a device other than the multi-functional peripheral 1, when the recording sheet 19 is stopped by the output roller pair 55. The processes of Steps SA13 to SA21 may be performed by a first control unit.

In another embodiment, the Step SA14 in which the microcomputer 130 determines whether the instruction for image recording is received from another device may comprise two steps: a step for determining whether the instruction for image recording is received from another device disposed in a room in which the multi-functional peripheral 1 is disposed, and a step for determining whether the instruction for image recording is received from another device disposed outside of the room in which the multi-functional peripheral 1 is disposed. If the instruction for image recording is received from another device disposed in a room in which the multi-functional peripheral 1 is disposed, the forced output process may be performed. If the instruction for image recording is received from another device disposed outside of the room in which the multi-functional peripheral 1 is disposed, the notification process may be performed.

Figure 5:
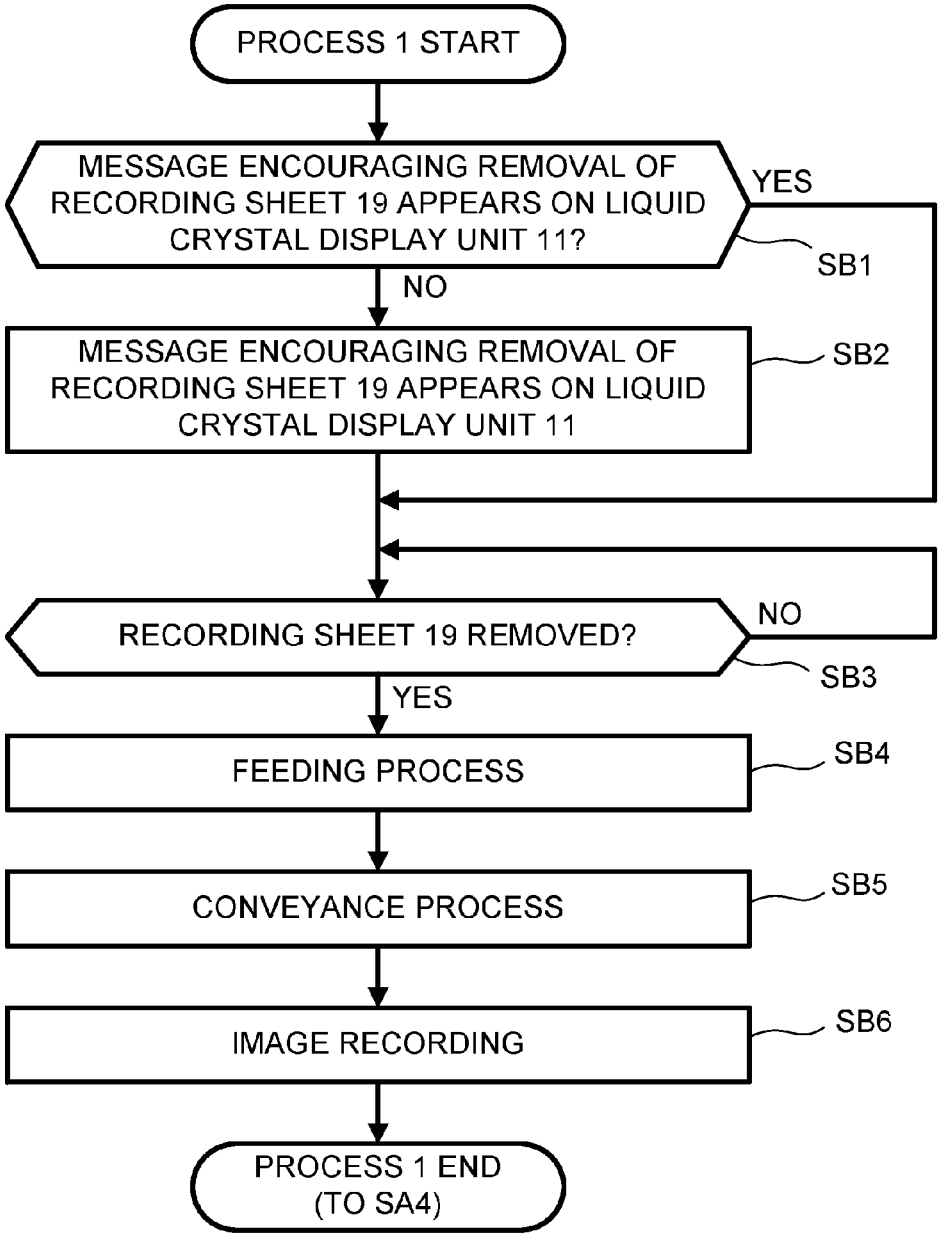
FIG. 5 is a flowchart depicting a notification process according to one or more aspects of the invention.

As depicted in FIG. 5, a flowchart for process 1 of Step SA15 is depicted. If no message notifying the user to remove the recording sheet 19 appears on the liquid crystal display unit 11 or at the external information equipment accordingly to Step SA13, e.g., NO at Step SB1, the microcomputer 130 may display a message on the liquid crystal display unit 11 notifying the user to remove the recording sheet 19 at Step SB2. The microcomputer 130 may determine whether the recording sheet 19 is removed from the output tray 21 at Step SB3.

If a predetermined period of time has elapsed before the multi-functional peripheral 1 is operated after Step SA9, the multi-functional peripheral 1 may enter a power saving mode during which the liquid crystal display unit 11 may be turned off. When the operation button 10 of the multi-functional peripheral 1 is pressed after Step SA9, a menu and the like corresponding to the pressed button 10 may be displayed on the liquid crystal display unit 11, such that the message displayed on the liquid crystal display unit 11 at Step SA9 may be replaced by the menu. At Step SB2, the message notifying the user to remove the recording sheet 19 again may be displayed on the liquid crystal display unit 11. If the message displayed in Step SA9 still is displayed on the liquid crystal display unit 11, e.g., YES at Step SB1, the process may proceed to Step SB3 without performing Step SB2.

When the recording sheet 19 held by the output roller pair 55 is removed by the user in response to the display of the notification message, e.g., YES at Step SB3, an image may be recorded on a new recording sheet 19, e.g., next recording sheet. In accordance with command received in Step SA13, the feeding process in Step SB4, the conveyance process in Step SB5 and the image recording process in Step SB6 may be performed. The microcomputer 130 may convey the recording sheet 19 at predetermined linefeed width and may discharge the ink droplets until the entire image is recorded on the recording sheet 19. In step SB3, the microcomputer 130 may determine that the recording sheet 19 held by the output roller pair 55 has been removed when the electrical signal from the optical sensor 121 has changed from a HIGH level signal to a LOW level signal.

Figure 6:
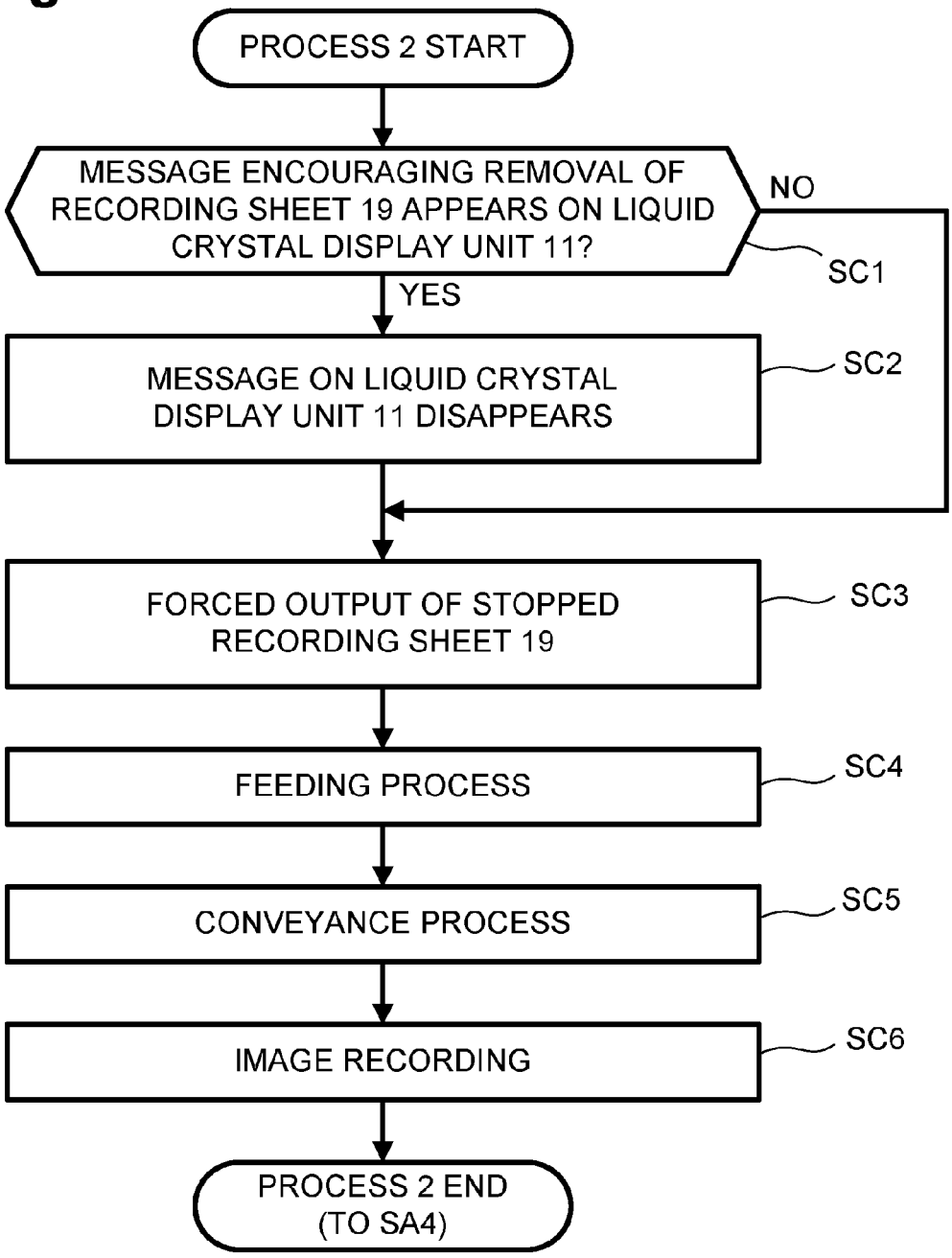
FIG. 6 is a flowchart depicting a forced output process according to one or more aspects of the invention.

As depicted in FIG. 6, a flowchart for process 2 of Step SA17 is depicted. If the message notifying the user to remove the recording sheet 19 is displayed on the liquid crystal display unit 11, e.g., YES in Step SC1, the microcomputer 130 may remove the message from the screen of the liquid crystal display unit 11 at Step SC2. If no message notifying the user to remove the recording sheet 19 is displayed on the liquid crystal display unit 11, e.g., NO in Step SC1, the process may proceed to step SC3 without performing the process of Step SC2. If the message notifying the user to remove the recording sheet 19 is covered by another message or menu, the covered message may be removed.

The microcomputer 130 may control the conveying motor 59 to rotate the output roller 49 at Step SC3, such that the recording sheet 19 held by the output roller pair 55 may be conveyed in the conveying direction 15 and may be output to the paper output tray 21. The process of step SC3 may correspond to a forced output process. After the forced output is performed, a message indicating that forced output of the recording sheet 19 has been performed may be displayed on the liquid crystal display unit 11.

The feeding process in Step SC4, the conveyance process in Step SC5, and the image recording process in Step SC6 may be performed in response to the command received in Step SA13. The microcomputer 130 may convey the recording sheet 19 at predetermined linefeed width and may discharge the ink droplets until the entire image is recorded on the recording sheet 19.

Figure 7:
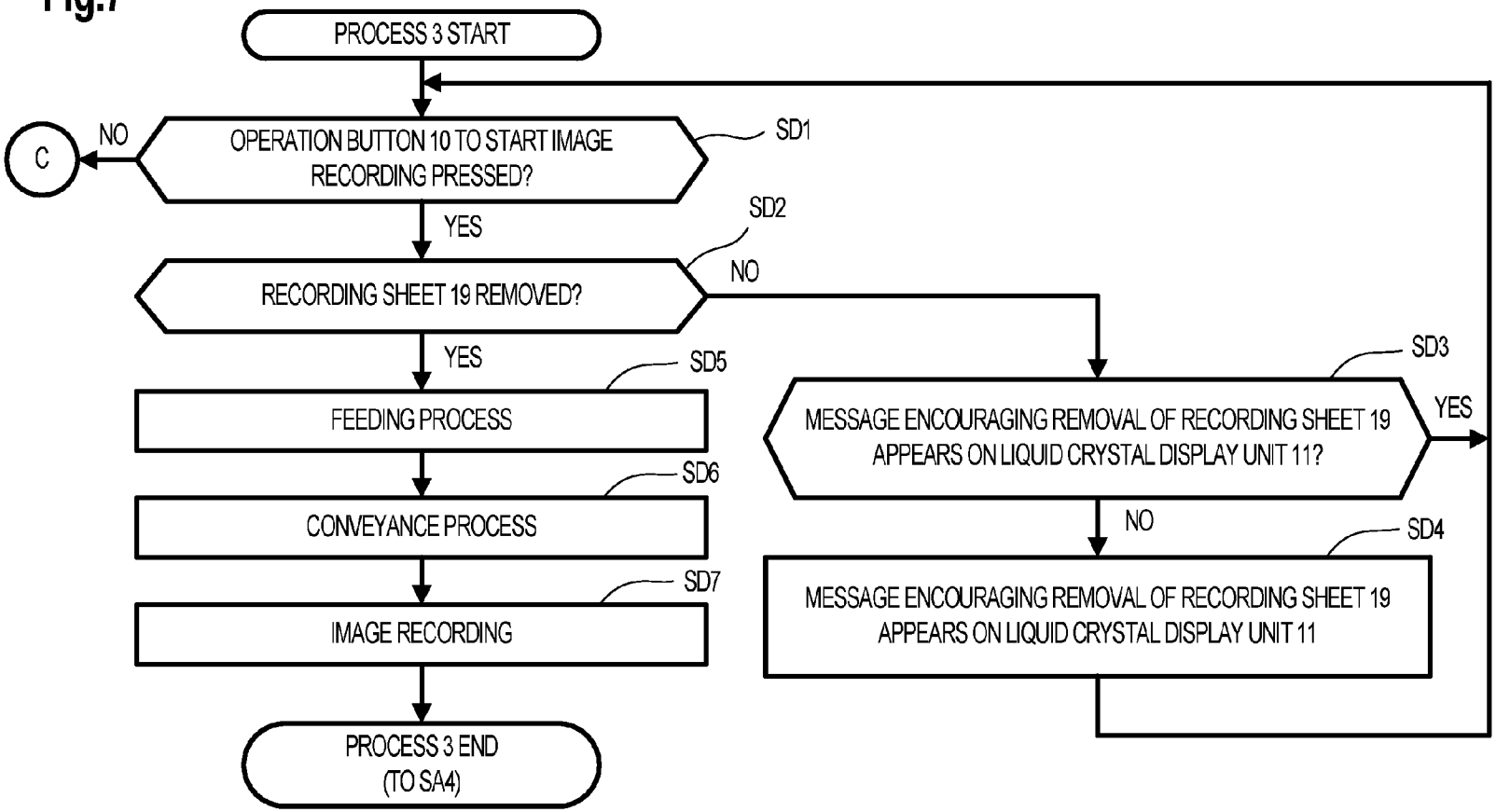
FIG. 7 is a flowchart depicting another notification process according to one or more aspects of the invention.

As depicted in FIG. 7, a flowchart for process 3 of Step SA19 is depicted. When a button for starting image recording among a plurality of operation buttons 10 on the operation panel 9 is pressed by the user, e.g., YES at Steps SA18 and SD1, the microcomputer 130 may determine whether the recording sheet 19 held by the output roller pair 55 has been removed at Step SD2, based on an electrical signal from the optical sensor 121. If the button is not pressed, NO at Step SD1, the process may proceed to step SA13. The button may be pressed by the user for copying an original document placed on a platen glass of the document table 35 and for recording image data stored in a memory card inserted in a slot 7 on a front surface of the multi-functional peripheral 1.

If the recording sheet 19 has not been removed, e.g., NO at Step SD2, the microcomputer 130 may determine whether a message notifying the user to remove the recording sheet 19 has been displayed on the liquid crystal display unit 11 at Step SD3. If no message has been displayed, e.g., NO at Step SD3, a message notifying the user to remove the recording sheet 19 may be displayed on the liquid crystal display unit 11 at Step SD4, and the process then may proceed to Step SD1. If a message has been displayed, e.g., YES at Step SD3, the process may proceed to Step SD1 without performing Step SD4. If the recording sheet 19 has been removed in step S2, e.g., YES at SD2, the feeding process in Step SD5, the conveyance process in Step SD6, and the image recording process in Step SD7 may be performed in response to the commands received in step SA13. The microcomputer 130 may convey the recording sheet 19 at predetermined linefeed width and may discharge the ink droplets until the entire image is recorded on the recording sheet 19.

Figure 8:
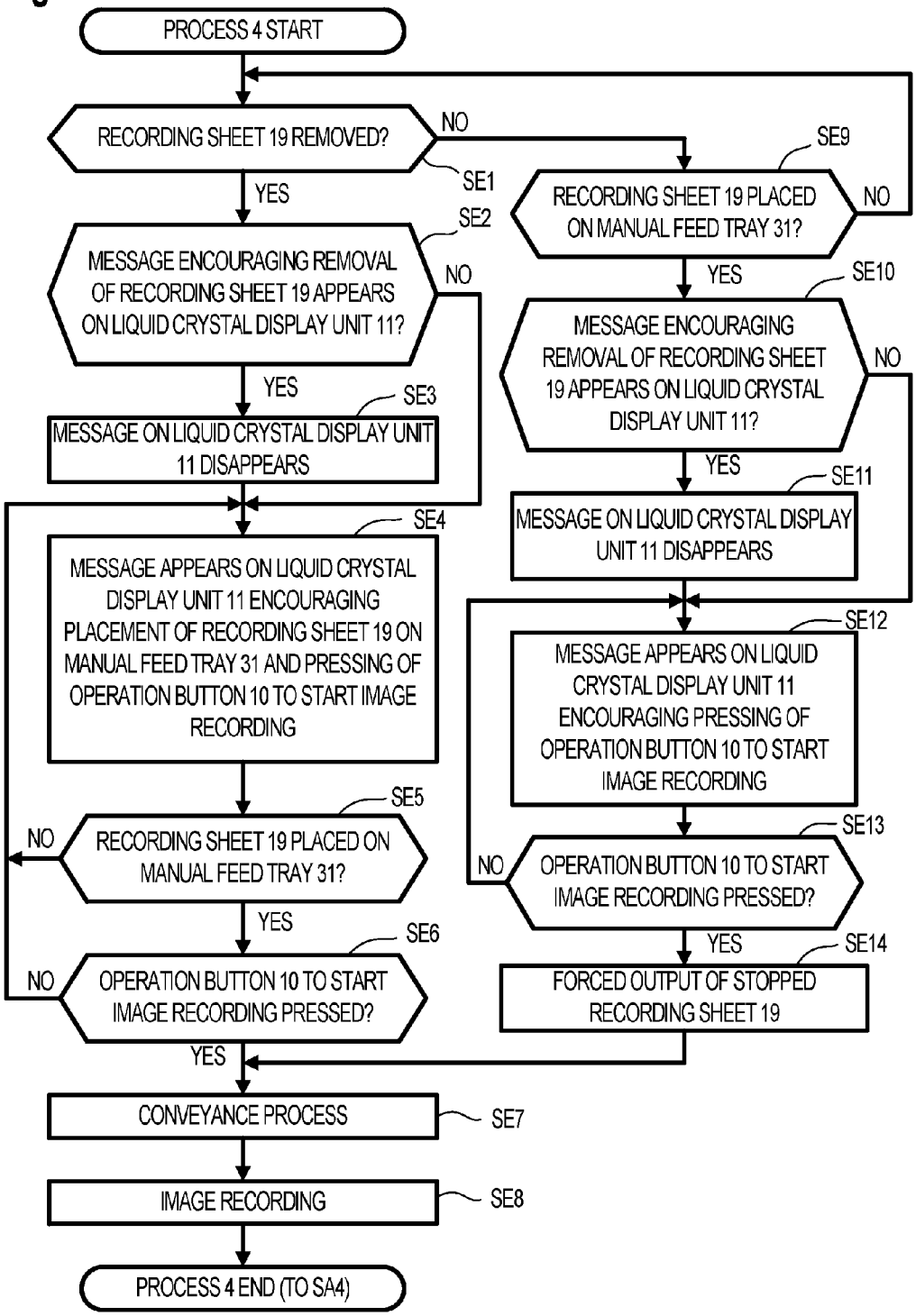
FIG. 8 is a flowchart depicting a notification and forced output process according to one or more aspects of the invention.

As depicted in FIG. 8, a flowchart for process 4 of Step SA21 is depicted. The microcomputer 130 may determine whether the recording sheet 19 held by the output roller pair 55 has been removed by the user at Step SE1. If the recording sheet 19 has been removed, e.g., YES at Step SE1, the same processes for Steps SE2 and SE3, which are similar to those of Steps SC1 and SC2, may be performed. The microcomputer 130 may display a message on the liquid crystal display unit 11 to notify the user to place the recording sheet 19 on the manual feed tray 31 and to press one of the plurality of operation buttons 10 for starting the image recording at Step SE4.

If the recording sheet 19 is placed on the manual feed tray 31, e.g., YES at Step SE5, and a button for starting the image recording is pressed, e.g., YES at Step SE6, the microcomputer 130 may drive the conveying motor 59 to rotate the conveyance roller 47. The recording sheet 19 received in the manual feed tray 31 may be conveyed by the conveyance roller pair 54 to a position directly below the recording head 65 at Step SE7. The image may be recorded on the recording sheet 19 at Step SE8. The multi-functional peripheral 1 may comprise a mechanism for feeding the recording sheet 19 received in the manual feed tray 31, and the feeding process may be performed by the mechanism between Steps SE6 and SE7.

The microcomputer 130 may convey the recording sheet 19 at predetermined linefeed width and may discharge of the ink droplets at Steps SA2 and SA3, until the entire image is recorded on the recording sheet 19 at Step SA4. The microcomputer 130 may determine whether the recording sheet 19 has been placed on the manual feed tray 31, based on the electrical signal input from the optical sensor 111 of the paper sheet detecting unit 110.

If the recording sheet 19 is not removed, e.g., NO at Step SE1, the microcomputer 130 may determine whether the recording sheet 19 is placed on the manual feed tray 31 at Step SE9. If the recording sheet 19 is placed on the manual feed tray 31, e.g., YES at Step SE9, the processes for Steps SE10 and SE11, which are similar to those of Steps SC1 and SC2, may be performed. The microcomputer 130 may display a message on the liquid crystal display unit 11 notifying the user to press a button among a plurality of operation buttons 10 for starting image recording at Step SE12. If the button for starting image recording is pressed by the user, e.g., YES at Step SE13, the microcomputer 130 may perform force output of the recording sheet 19 held by the output roller pair 55 to the paper output tray 21 at Step SE14. The process may proceed to Step SE7 after Step SE14.

If the recording sheet 19 is not removed, e.g., NO at SE1, and the operation button 10 for starting image recording is pressed, e.g., YES at SE13, after the recording sheet 19 is placed on the manual feed tray 31, forced output may be performed at Step SE14. If the operation button 10 for starting image recording is pressed before the recording sheet 19 is placed on the manual feed tray 31, forced output may be performed immediately after the recording sheet 19 is placed on the manual feed tray 31.

When the paper sheet detecting unit 110 detects a recording sheet 19 on the manual feed tray 31, e.g., YES at Step SE9, the microcomputer 130 may perform the forced output process at Step SE14 and may record an image on a new recording sheet 19 at Steps SE7 and SE8.

If a command for image recording on the recording sheet 19 is received from the operation panel 9 or from a device other than the multi-functional peripheral 1, e.g., from external information equipment, when the recording sheet 19 is held by the output roller pair 55 at Step SA13, the microcomputer 130 may perform the notification process by displaying a message on the liquid crystal display unit 11 at Steps SA15, SA19, and SA21, or the microcomputer 130 may perform forced output of the recording sheet 19 at Steps SA17 and SA21, based on where the command is issued from. The display of the message on the liquid crystal display unit 11 may notify the user. The forced output of the recording sheet 19 may allow the image recording process to begin promptly in response to the received command.

If the size of the paper sheet 19 conveyed along the conveyance path 23 is greater than the size of the paper output tray 21, e.g., YES at Step SA5, the recording sheet 19 may be held by the output roller pair 55 at Step SA8, such that the recording sheet 19 may not fall from the paper output tray 21. If the size of the paper sheet 19 conveyed along the conveyance path 23 is less than or equal to the size of the paper output tray 21, e.g., NO at Step SA5, the recording sheet 19 may be output to the paper output tray 21 at Step SA6 without being held at the output roller pair 55, such that image recording on the next recording sheet 19 may begin without delay.

The recording sheet 19 may be nipped between the output roller 49 and the spur 50 as the output roller 49 rotates, and the recording sheet 19 may be conveyed in the conveying direction 15. The recording sheet 19 may be held between the output roller 49 and the spur 50 when the rotation of the output roller 49 stops.

Image data received by facsimile may be stored in volatile memory, e.g., the RAM 133. The image data stored in the memory may be recorded on the recording sheet 19. When the multi-functional peripheral 1 is powered off and the image data stored in the volatile memory is not yet recorded on the recording sheet 19, the image data stored in the memory may be lost. Thus, forced output may be performed at Steps SA17 and SC3 when the image data is received by facsimile, e.g., YES at SA16, such that recording of the image data on the recording sheet 19 may be started promptly. Therefore, the possibility that the image data received by facsimile is lost due to powering-off may be reduced.

If the command is issued from another device, e.g., external information equipment, the user who operated the another device to issue the command may be away from the multi-functional peripheral 1 in which image recording is performed. Thus, the user may not notice that the forced output process is performed on the recording sheet 19 held by the output roller pair 55 is performed, such that the recording sheet 19 may fall from the multi-functional peripheral 1. Therefore, when the command is issued from another device, notification may be displayed at the another device, such that the user may be notified before a forced output process to prevent the recording sheet 19 from falling from the multi-functional peripheral 1.

If the command is input on the operation panel 9, the user who operated the operation panel 9 may be close to the multi-functional peripheral 1 in which image recording is performed. The notification may be displayed as a message on the liquid crystal display unit 11, such that the user, who is close to the multi-functional peripheral 1, may be notified, and the user may promptly remove the recording sheet 19 held by the output roller pair 55.

The paper sheet detecting unit 110 may detect the recording sheet 19 when the user placed the recording sheet 19 on the manual feed tray 31. Thus, the user may be close to the multi-functional peripheral 1 in which image recording is performed, and the user may remove the recording sheet 19 before the recording sheet 19 falls from the multi-functional peripheral 1 after the forced output process.

The microcomputer may determine whether the recording sheet 19 held by the output roller pair 55 has been removed based on the detection of the recording sheet 19 by the output detecting unit 120. If the recording sheet 19 is removed, an image may be recorded promptly on the next recording sheet 19.

In a first modified embodiment, the microcomputer 130 may convey the recording sheet 19 at a conveying speed during the forced output process in Steps SA17 and SA21 less than the conveying speed of the recording sheet 19 when the recording sheet 19 is output without being stopped and held by the output roller pair 55.

The conveying speed of the recording sheet 19, when the recording sheet 19 is output without being stopped and held by the output roller pair 55, may be the speed at which the paper sheet 19 having an image recorded thereon is conveyed and may be set at a greater value. The microcomputer 130 may reduce the rotational speed of the output roller 49 by reducing the driving current output to the conveying motor 59 from the driving circuit included in the ASIC 135, such that the conveying speed of the recording sheet 19 may be reduced. The user may be notified of the recording sheet 19 being forced output from the paper output tray 21 at a reduced speed and may prevent the recording sheet from falling from the multi-functional peripheral 1.

In process 2, e.g., Step SA17, if the command to record an image on the next recording sheet 19 is to receive image data by facsimile from another device, e.g., external information equipment, other than the multi-functional peripheral 1, e.g., YES at Step SA16, the message on the liquid crystal display unit 11 may be removed at Step SC2 and the forced output process may be performed at Step SC3. In a second modified embodiment, the microcomputer 130 may display the message on the liquid crystal display unit 11 for a predetermined period of time after image data is received by facsimile. The microcomputer 130 may perform the forced output at Step SC3 after the predetermined period of time elapses since the image data is received by facsimile. The predetermined period of time may be set, such that the user may reach the multi-functional peripheral 1 after a signal, e.g., a buzzer sound, indicating the reception by facsimile is issued by the multi-functional peripheral 1. For example, the predetermined period of time may be about one minute. Thus, the user may notice the reception of image data in the predetermined period of time and may reach the multi-functional peripheral 1 to prevent the recording sheet 19 from falling from the multi-functional peripheral 1 after the forced output.

The image data received by facsimile may be recorded on the recording sheet 19. In a third modified embodiment, the image data received by facsimile may be stored in the EEPROM 134 of the multi-functional peripheral 1. If the command to record an image on the next recording sheet 19 is to receive the image data by facsimile from another device, e.g., external information equipment, other than the multi-functional peripheral 1, e.g., YES at Step SA16, the microcomputer 130 may store the image data in the EEPROM 134. The microcomputer 130 may display a message on the liquid crystal display unit 11 notifying the user to remove the recording sheet 19 of which conveyance is stopped while being held by the output roller pair 55, without performing the forced output process at Step SC3. The image data received by facsimile may be stored in the EEPROM 134, e.g., a nonvolatile memory, such that the image data is maintained in the EEPROM 134 when the multi-functional peripheral 1 is powered off. Forced output may not be performed when the image data is received by facsimile, and the notification may be displayed on the liquid crystal display unit 11. Thus, the recording sheet 19 may not fall from the multi-functional peripheral 1 due to the forced output process.

If the command to record an image on the next recording sheet 19 is issued via the operation panel 9, e.g., YES at Step SA18, the microcomputer 130 may display the message on the liquid crystal display unit 11 at Steps SA19. In a fourth modified embodiment, if the command to record an image on the next recording sheet 19 is issued via the operation panel 9, e.g., YES at Step SA18, the microcomputer 130 may perform the forced output, instead of displaying the message on the liquid crystal display unit 11. If the command is input on the operation panel 9, the user, who operated the operation panel 9, may be close to the multi-functional peripheral 1 in which image recording is performed. Therefore, the user may notice that the recording sheet 19 is forced to output without a notification message, and the user may remove the recording sheet 19 before the recording sheet 19 falls from the multi-functional peripheral 1.

In a fifth modified embodiment, image data that is not used for recording an image on the recording sheet 19 may be cumulatively stored in the RAM 133. When a plurality of image data for image recording are received in the multi-functional peripheral 1, the multi-functional peripheral 1 may record the plurality of image data on the recording sheet 19 in a first-in first-out manner. The plurality image data may be stored in the RAM 133 in the order in which it is received.

Figure 9:
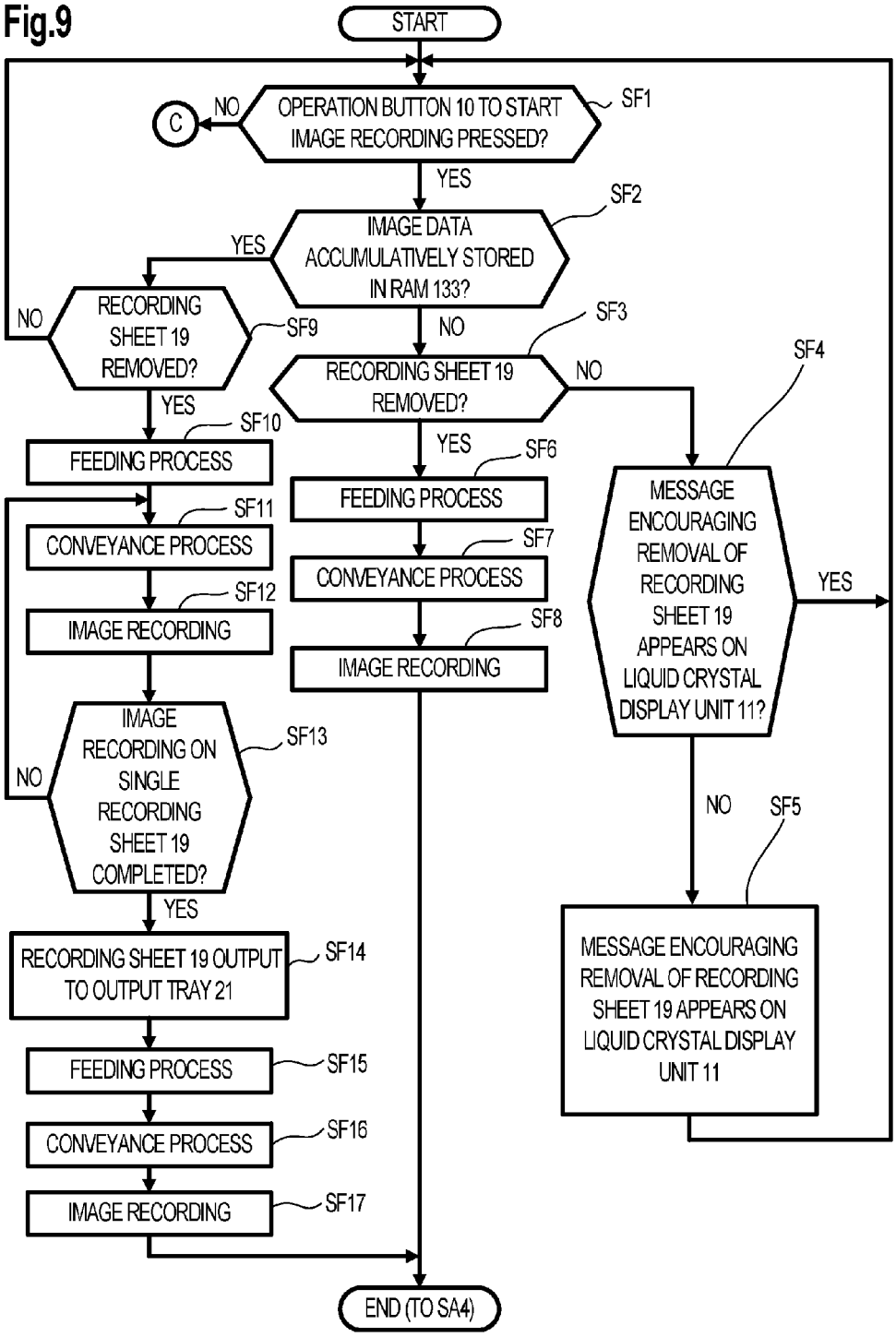
FIG. 9 is a flowchart depicting a process of record control in another embodiment according to one or more aspects of the invention.

When a command for image recording is received via the operation panel 9 and when the image data is cumulatively stored in the RAM 133, e.g., YES at Step SA18, the microcomputer 130 may perform forced output and may control the recording unit 24 to record an image on the recording sheet 19 in accordance with the command received via the operation panel 9 after the forced output and to record the image data accumulatively stored in the RAM 133 on the recording sheet 19. FIG. 9 is a flow chart depicting the fifth modified embodiment, e.g., a modified process 3. As depicted in FIG. 9, the command received via the operation panel 9 may be a command for recording an image of a single original document on a single recording sheet. The single original document may be placed on the platen glass of the document table 35.

If the user presses one of the plurality of operation buttons 10 provided on the operation panel 9 to start image recording, a command to copy the original document may be output to the microcomputer 130. Upon reception of the command, e.g., YES at Step SF1, the microcomputer 130 may determine whether the image data is cumulatively stored in the RAM 133 at Step SF2. If the button is not pressed, e.g., NO at Step SF1, the process may proceed to Step SA13.

If no image data is cumulatively stored in the RAM 133, e.g., NO at Step SF2, Steps SF3 to SF8, similar to Steps SD2 to SD7, may be performed. The microcomputer 130 may convey the recording sheet 19 at predetermined linefeed width and may discharge the ink droplets until the entire image is recorded on the recording sheet 19.

If the image data is accumulatively stored in the RAM 133, e.g., YES at Step SF2, the microcomputer 130 may determine, in accordance with the electrical signal from the optical sensor 121, whether the recording sheet 19 held by the output roller pair 55 has been removed at Step SF9. If the recording sheet 19 has not been removed, e.g., NO at Step SF9, the process may return to Step. If the recording sheet 19 has been removed, e.g., YES at Step SF9, Steps SF10 to SF13, which are similar to Steps SA1 to SA4, may be performed in accordance with the command received in Step SF1 to copy the original document. The paper sheet 19 having an image recorded thereon may be output to the top surface of the paper output tray 21 at Step SF14.

The microcomputer 130 may record the image data cumulatively stored in the RAM 133 on the recording sheet 19. In particular, the microcomputer 130 may perform the feeding process at Step SF15, the conveyance process at Step SF16 and the image recording at Step SF17, similar to Steps SA1 to SA3. The microcomputer 130 may convey the recording sheet 19 at predetermined linefeed width and may discharge the ink droplets until the entire image is recorded on the recording sheet 19.

If a user instructs recording of the image data cumulatively stored in the RAM 133 when the image data is cumulatively stored in the RAM 133, the user may not wish to use the paper sheet 19 having an image recorded thereon immediately. On the contrary, the user who instructs image recording on the recording sheet 19 on the manipulation panel 9 wishes to use the paper sheet 19 having an image recorded thereon immediately. Therefore, the latter image recording may be given higher priority to the former image recording in the fifth modification. The user who wishes to obtain the paper sheet 19 having an image recorded thereon may receive the paper sheet 19 without undue delay.

In the fifth modification, the microcomputer 130 may determine whether the image data cumulatively stored in the RAM 133 is image data received by facsimile before step SF15 is performed. The determination is made by, for example, setting a flag in the header of the received image data indicating that the data is received by facsimile. That is, the microcomputer 130 refers to the header of the image data cumulatively stored in the RAM 133 before step SF15 is performed. Then microcomputer 130 determines whether the image data has been received by facsimile with reference to the flag.

In a sixth modified embodiment, if the image data cumulatively stored in the RAM 133 has been received by facsimile, the microcomputer 130 may not record the image data on the recording sheet 19.

The content of the image data received by facsimile may be displayed on the liquid crystal display unit 11. After viewing the content of the image data on the liquid crystal display unit 11, the user may not wish to record the image data on the recording sheet 19. The microcomputer 130 may not record the image data received by facsimile on the recording sheet 19.

The multi-functional peripheral 1 further may comprise an output button for outputting the recording sheet 19 stopped by the output roller pair 55 to the paper output tray 21. The output button may be one of a plurality of operation buttons 10.

In a seventh modified embodiment, the microcomputer 130 may display a message on the liquid crystal display unit 11 notifying the user to press the output button, instead of a message notifying the user to remove the recording sheet 19 held by the output roller pair 55. If the output button is pressed by the user, the microcomputer 130 may perform the forced output of the recording sheet 19. When a command for image recording has been received, the microcomputer 130 may record an image on a new recording sheet 19.

When the output button is pressed, the forced output of the recording sheet 19 may be performed. Therefore, the user may remove the recording sheet 19 from the conveyance path 23 without holding the recording sheet 19 held by the output roller pair 55.

The output roller pair 55 may correspond to the stopper unit of the present invention and the paper sheet 19 having an image recorded thereon may be held by the output roller pair 55. In a ninth modified embodiment, the stopper unit may be a holding member which holds, in cooperation with the inner guide member 28, the left and right ends of the paper sheet 19 having an image recorded thereon. The holding member may be disposed between the recording unit 24 and the paper output tray 21 in the front-rear direction 12 along the conveyance path 23. The holding member may be disposed in the left-right direction 13 to correspond to the left and right ends of the recording sheet 19 being conveyed along the conveyance path 23. The holding member may be disposed above the inner guide member 28 in the vertical direction 14. The inner guide member 28 may define the lower side of the conveyance path 23. The holding member selectively move between the first position and the second position. At the first position, the holding member may extend upwardly away from inner guide member 28, and a space may be formed between the holding member and the inner guide members 28. At the second position, the holding member may contact the inner guide member 28. The holding member may move according to the control of the microcomputer 130.

When the paper sheet 19 having an image recorded thereon is conveyed directly below the holding member, the microcomputer 130 may move the holding member from the first position to the second position. Thus, the recording sheet 19 may be held between the holding member and the inner guide member 28. Then, the recording sheet may not be output to the paper output tray 21 until the microcomputer 130 control the holding member to move from the second position to the first position.

While the invention has been described in connection with various exemplary structures and illustrative embodiments, it will be understood by those skilled in the art that other variations and modifications of the structures, configurations, and embodiments described above may be made without departing from the scope of the invention. For example, this application comprises any possible combination of the various elements and features disclosed herein, and the particular elements and features presented in the claims and disclosed above may be combined with each other in other ways within the scope of the application, such that the application should be recognized as also directed to other embodiments comprising any other possible combinations. Other structures, configurations, and embodiments will be apparent to those skilled in the art from a consideration of the specification or practice of the invention disclosed herein. It is intended that the specification and the described examples are illustrative with the true scope of the invention being defined by the following claims.

What is claimed is:

1. An image recording device, comprising:

a recording unit configured to record an image on a paper sheet conveyed in a conveying direction along a conveyance path;

a paper output tray disposed downstream from the recording unit in the conveying direction and configured to receive the paper sheet;

a paper feed tray configured to feed the paper sheet to the conveyance path;

a stopper unit disposed between the recording unit and the paper output tray along the conveyance path and configured to hold the paper sheet to stop the conveyance of the paper sheet;

a notifying unit configured to issue a notification requesting removal of the paper sheet held by the stopper unit;

a control unit configured to control at least one of the notifying unit to issue the notification requesting the removal of the paper sheet and the stopper unit to release the paper sheet to allow the conveyance of the paper sheet, based on where, along the conveyance path during conveying, an instruction for recording an image on another paper sheet is originated, when the paper sheet is held by the stopper unit; and a particular detecting unit configured to detect a size of the paper sheet conveyed along the conveyance path, wherein the control unit is configured to control the stopper unit to hold the paper sheet to stop the conveyance of the paper sheet when the particular detecting unit detects that the size of the paper sheet conveyed along the conveyance path is greater than a size of the paper output tray.

2. The image recording device according to claim 1, further comprising an output button configured to received a user instruction for outputting the paper sheet held by the stopper unit to the paper output tray, wherein the control unit is configured to control the image recording device to perform a forced output process in which the paper sheet is released and conveyed to the paper output tray when the output button is operated.

3. The image recording device according to claim 1, wherein the stopper unit comprises a first roller and a second roller opposite from the first roller across the conveyance path, and wherein the stopper unit is configured to selectively hold the paper sheet and convey the paper sheet in the conveying direction.

4. The image recording device according to claim 3, wherein the control unit is configured to control the first and second rollers to convey the paper sheet, such that a conveying speed of the paper sheet is reduced after the paper sheet is held by the stopper unit.

5. The image recording device according to claim 1, wherein the control unit is configured to control the image recording device to perform a forced output process in which the paper sheet is released and conveyed to the paper output tray when the paper sheet is held by the stopper unit and the instruction for recording an image on another paper sheet is received by facsimile.

6. The image recording device according to claim 5, wherein the control unit is configured to control the notifying unit to issue the notification for a predetermined period of time after the instruction for recording an image on another paper sheet is received by facsimile, and control the image recording device to perform the forced output process after the predetermined period of time.

7. The image recording device according to claim 1, further comprising a storage unit configured to store image data received by facsimile, wherein the control unit is configured to store the image data received by facsimile in the storage unit and control the notifying unit to issue the notification when the paper sheet is held by the stopper unit and the image data is received by facsimile.

8. The image recording device according to claim 1, wherein, when the paper sheet is held by the stopper unit and the instruction for recording an image on another paper sheet is originated from another device other than the image recording device, the control unit is configured to control the notifying unit to issue the notification requesting removal of the paper sheet to the another device.

9. The image recording device according to claim 1, further comprising an operation unit configured to receive a user instruction for image recording, wherein, when the paper sheet is held by the stopper unit and the instruction for recording an image on another paper sheet is originated from the operation unit, the control unit is configured to control the notifying unit to issue the notification.

10. The image recording device according to claim 1, further comprising an operation unit configured to receive a user instruction for image recording, wherein, when the paper sheet is held by the stopper unit and the instruction for recording an image on another paper sheet is originated from the operation unit, the control unit is configured to control the image recording device to perform a forced output process in which the paper sheet is released and conveyed to the paper output tray.

11. The image recording device according to claim 1, further comprising:

a storage unit configure to store image data not yet recorded on a paper sheet; and an operation unit configured to receive a user instruction for image recording, wherein, when the paper sheet is held by the stopper unit, the instruction for recording an image on another paper sheet is originated from the operation unit, and the storage unit contains image data not yet recorded on a paper sheet, the control unit is configured to control the image recording device to perform a forced output process in which the paper sheet is released and conveyed to the paper output tray and control the recording unit to record an image on the another paper sheet based on the instruction for recording an image on another paper sheet originated from the operation unit before controlling the recording unit to record the image data stored in the storage unit.

12. The image recording device according to claim 11, wherein the image data not yet recorded on a paper sheet comprises at least image data received by facsimile, and wherein the control unit is configured to record the image data stored in the storage unit on a paper sheet, except for the image data received by facsimile.

13. The image recording device according to claim 1, further comprising a further detecting unit disposed at the paper feed tray and configured to detect a paper sheet fed in the paper feed tray, wherein, when the paper sheet is held by the stopper unit and the further detecting unit detects that the another paper sheet is fed in the paper feed tray, the control unit is configured to control the image recording device to perform a forced output process in which the paper sheet is released and conveyed to the paper output tray.

14. The image recording device according to claim 1, further comprising a third detecting unit disposed between the recording unit and the paper output tray along the conveyance path and configured to detect a paper sheet held by the stopper unit, wherein the control unit is configured to record an image on the another paper sheet after the third detecting unit detects that the paper sheet is not held by the stopper unit.

15. A non-transitory computer-readable storage medium storing computer executable instructions to be executed by a processing device of an image recording device, such that the image recording device perform the steps of:

feeding a paper sheet from a paper feed tray to a conveyance path;

recording an image on the paper sheet conveyed along the conveyance path;

holding the paper sheet to stop the conveyance of the paper sheet;

selectively issuing a notification requesting removal of the paper sheet held by the holding step or releasing the paper sheet held by the holding step, or both, based on where, along the conveyance path during conveying, an instruction for recording an image on another paper sheet is originated; and detecting a size of the paper sheet conveyed along the conveyance path;

wherein the holding the paper sheet comprises stopping the conveyance of the paper sheet when detecting that the size of the paper sheet conveyed along the conveyance path is greater than a size of a paper output tray.

16. An image recording method comprising steps of:

feeding a paper sheet from a paper feed tray to a conveyance path;

recording an image on the paper sheet conveyed along the conveyance path;

holding the paper sheet to stop the conveyance of the paper sheet;

selectively issuing a notification requesting removal of the paper sheet held by the holding step or releasing the paper sheet held by the holding step, or both, based on where, along the conveyance path during conveying, an instruction for recording an image on another paper sheet is originated; and detecting a size of the paper sheet conveyed along the conveyance path;

wherein the holding the paper sheet comprises stopping the conveyance of the paper sheet when detecting that the size of the paper sheet conveyed along the conveyance path is greater than a size of a paper output tray.

* * * * *